US005423382A

United States Patent [19]

Barton et al.

[11] Patent Number: 5,423,382

[45] Date of Patent: Jun. 13, 1995

[54] APPARATUS FOR RELEASING PERFORATING GUN EQUIPMENT FROM A WELL CASING

[75] Inventors: John A. Barton, Arlington, Tex.; Robert G. Davidson, Peterculter, United Kingdom; James F. Wilkin, Edmonton, Canada

[73] Assignee: Dresser Industries, Inc., Dallas, Tex.

[21] Appl. No.: 150,713

[22] Filed: Nov. 10, 1993

[51] Int. Cl.[6] ..... E21B 43/116

[52] U.S. Cl. ..... 166/297; 166/55; 175/4.52

[58] Field of Search ..... 166/297, 55, 382, 383, 166/215; 175/4.52

[56] References Cited

U.S. PATENT DOCUMENTS

| | | | |
|---|---|---|---|
| 1,875,583 | 9/1932 | Fox . | |
| 2,749,840 | 6/1956 | Babcock | 102/20 |
| 2,799,224 | 7/1957 | Long | 102/20 |
| 2,853,944 | 9/1958 | Robertson | 102/20 |
| 2,873,675 | 2/1959 | Lebourg | 102/20 |
| 2,876,843 | 3/1959 | Huber | 166/55 |
| 2,906,339 | 9/1959 | Griffin | 166/35 |
| 2,981,185 | 4/1961 | Caldwell | 102/20 |
| 3,032,109 | 5/1962 | Corley, Jr. et al. | 166/55.4 |
| 3,058,523 | 10/1962 | McElheny | 166/55.4 |
| 3,706,344 | 12/1972 | Vann | 166/297 |
| 3,966,236 | 6/1976 | Vann | 285/39 |
| 4,066,282 | 1/1978 | Vann | 285/39 |
| 4,078,611 | 3/1978 | Vann | 166/297 |
| 4,122,899 | 10/1978 | Brieger | 166/297 |
| 4,375,834 | 3/1983 | Trott | 166/297 |
| 4,415,029 | 11/1983 | Pratt et al. | 166/212 |
| 4,526,233 | 7/1985 | Stout | 166/377 |
| 4,557,331 | 12/1985 | Stout | 166/297 |
| 4,614,156 | 9/1986 | Colle, Jr. et al. | 102/312 |
| 4,693,308 | 9/1987 | Luke et al. | 166/55.1 |
| 4,694,878 | 9/1987 | Gambertoglio | 166/377 |
| 4,771,827 | 9/1988 | Barker et al. | 166/55.1 |
| 4,776,393 | 10/1988 | Forehand et al. | 166/55.1 |
| 4,815,540 | 3/1989 | Wallbillich, III | 166/377 |
| 4,905,759 | 3/1990 | Wesson et al. | 166/55 |
| 5,007,344 | 4/1991 | Ricles, et al. | 102/31.2 |
| 5,025,861 | 6/1991 | Huber et al. | 166/297 |
| 5,050,682 | 9/1991 | Huber et al. | 166/377 |
| 5,095,993 | 3/1992 | Huber et al. | 166/382 |
| 5,156,213 | 10/1992 | George et al. | 166/297 |
| 5,211,224 | 5/1993 | Bouldin | 166/63 |
| 5,293,940 | 3/1994 | Itromas et al. | 166/376 X |

OTHER PUBLICATIONS

Guiberson Dresser—Service Tools (undated).

Guiberson Dresser—Seal Bore Packer Systems (undated).

*Primary Examiner*—William P. Neuder

*Attorney, Agent, or Firm*—Richards, Medlock & Andrews

[57] ABSTRACT

Apparatus engageable with a well casing for suspending a perforating gun in the casing. The apparatus includes toothed slips forced into engagement with the well casing. A spring maintains an engaging force on the slips with the casing. In response to detonation of the perforating gun, a first release mechanism is operated to allow the perforating gun to drop a short distance. After initial dropping of the perforating gun, a second release mechanism is operated to release the engagement of the toothed slips with the casing, thereby allowing the entire unit to fall to the bottom of the well. A retrieval tool attached to a tubing string can be utilized to operate the second release mechanism, disengage the unit from the casing, and retrieve it from the well.

20 Claims, 10 Drawing Sheets

APPARATUS FOR RELEASING PERFORATING GUN EQUIPMENT FROM A WELL CASING

TECHNICAL FIELD OF THE INVENTION

The present invention relates in general to apparatus utilized in conjunction with perforating equipment in the formation of production wells, and more particularly to equipment that can be attached to well casings for allowing perforation thereof, and for automatically releasing the equipment and perforating gun for dropping to the bottom of the well.

BACKGROUND OF THE INVENTION

Hydrocarbon and other resources that have been discovered can generally be made accessible by drilling wells down to the formation. In order to maintain the integrity of the well and to prevent cave-ins of the earth material, a rigid casing is installed in the wellbore. The underground deposits of the resources may occur at various levels in the wellbore. Completion of the well is generally accomplished by lowering one or more perforating guns into the wellbore casing, detonating the perforating gun(s) to perforate the casing sidewall at the various locations where the deposits exist. This allows the hydrocarbon or other resources to flow into the casing and be removed by pumps or other lift equipment.

In view that many hydrocarbon deposits exist in naturally-pressurized areas, the drilling, casing and perforating must be carried out with respect to the underground pressurized deposits. Drilling equipment and drill muds are often used to contain the well pressure once the wellbore has been drilled down to the formation. Capped well casings and other containment equipment are utilized during the casing and perforation operations to complete the well. It can be appreciated that in order to provide safe conditions and prevent waste of the resources, it is often necessary to conduct the well operations while maintaining confinement of the wellbore. To that end, it is necessary to minimize the number of times equipment is placed in or removed from a contained or capped wellbore.

The perforating operation is one activity that often requires the cased wellbore to be accessed several times. For example, the perforating gun must be lowered into the cased wellbore by a tubing string, wire line, or other equipment. Once the gun is detonated and the sidewall of the casing is perforated, the wellbore becomes pressurized as a result of high pressures in the formation forcing the hydrocarbons to flow through the perforations into the wellbore. At that time, it becomes extremely difficult to remove the perforating gun from the pressurized wellbore. In addition, the initial in rush of the hydrocarbons into the wellbore can often jam the suspended perforating gun and other equipment within the casing, thereby necessitating the removal thereof under the pressurized conditions.

In order to obviate the foregoing problem, perforating guns and associated equipment have been devised by those skilled in the art to eliminate the necessity of removing the spent perforating gun from the cased wellbore. U.S. Pat. Nos. 4,776,393 by Forehand et al.,; 5,050,682 by Huber et al.; and 5,156,213 by George et al. disclose various types of perforating guns and associated equipment. In general, the equipment in these noted patents allows the perforating gun to be lowered to the particular location in the cased wellbore and attached to the sidewalls thereof. Then, the tubing string, wire line or other cables can be removed from the well, and the well can be capped or otherwise contained. The perforating gun can be detonated by mechanical, hydraulic, or electrical techniques to thereby form the perforations in the sidewall of the casing. In response to the detonation of the perforating gun, a release mechanism is activated to release the equipment from the casing, thereby allowing it and the perforating gun to fall to the bottom of the well. In this manner, concerns in removing the perforating apparatus in a pressurized wellbore are thereby reduced. However, the perforating gun equipment disclosed in the above patents is subject to breakage and failure, thus representing a less than optimum solution. In addition, should the equipment, and especially the perforating gun, fail to operate, it must then be disengaged from the casing and removed so it can be repaired or replaced by other equipment.

From the foregoing, it can be seen that a need exists for a new, highly efficient, perforating and associated apparatus for providing a reliable and high quality attachment to the internal sidewall of the casing, as well as reliable operation in the disengagement thereof. Another need exists for a technique that is highly reliable in setting the equipment to the sidewall of the cased wellbore. Yet another need exists for a method and apparatus for retrieving the perforating gun and apparatus should it fail to fire or operate properly.

SUMMARY OF THE INVENTION

In accordance with the principles and concepts of the invention, perforating gun apparatus is disclosed that is responsive to a detonation of the gun for automatically releasing the entire assembly from engagement with the wellbore casing. Methods and apparatus are also disclosed for releasing the perforating gun and apparatus from engagement with the wellbore casing and retrieving the same for repair or replacement.

In the preferred embodiment of the invention, a toothed slip assembly is deployed by the action of telescopic components being compressed together and held in such a position by a spring. In this manner, pressure is maintained on toothed slips to assure good gripping action with the sidewall of the casing. A rachet mechanism maintains the telescopic members under the spring tension.

In accordance with another aspect of the invention, the apparatus includes a detonator assembly having a detonating cord that extends from the apparatus to operate the perforating gun. When the cord is purposefully detonated, the perforating gun is activated to perforate the well casing. In addition, the detonation of the cord activates a first release mechanism for releasing the perforating gun and dropping it a short distance from the gripping apparatus. The dropping of the perforating gun, in turn, is operative to release a second release mechanism, whereby the toothed slip assembly is released from its spring tension, thereby releasing the slips from the casing sidewall. The entire assembly then drops to the bottom of the cased wellbore.

According to another feature of the invention, a retrieval tool can be lowered into the cased wellbore to retrieve the unit should the perforating gun fail to operate. The retrieval tool is rotated to threadably engage with the gripping apparatus, and when fully mated, the retrieval tool mechanically releases the second release mechanism. The entire unit can then be pulled from the well.

BRIEF DESCRIPTION OF THE DRAWINGS

Further features and advantages will become apparent from the following and more particular description of the preferred embodiment of the invention, as illustrated in the accompanying drawings in which like reference characters generally refer to the same parts or elements through out the views, and in which.

Figure 5:
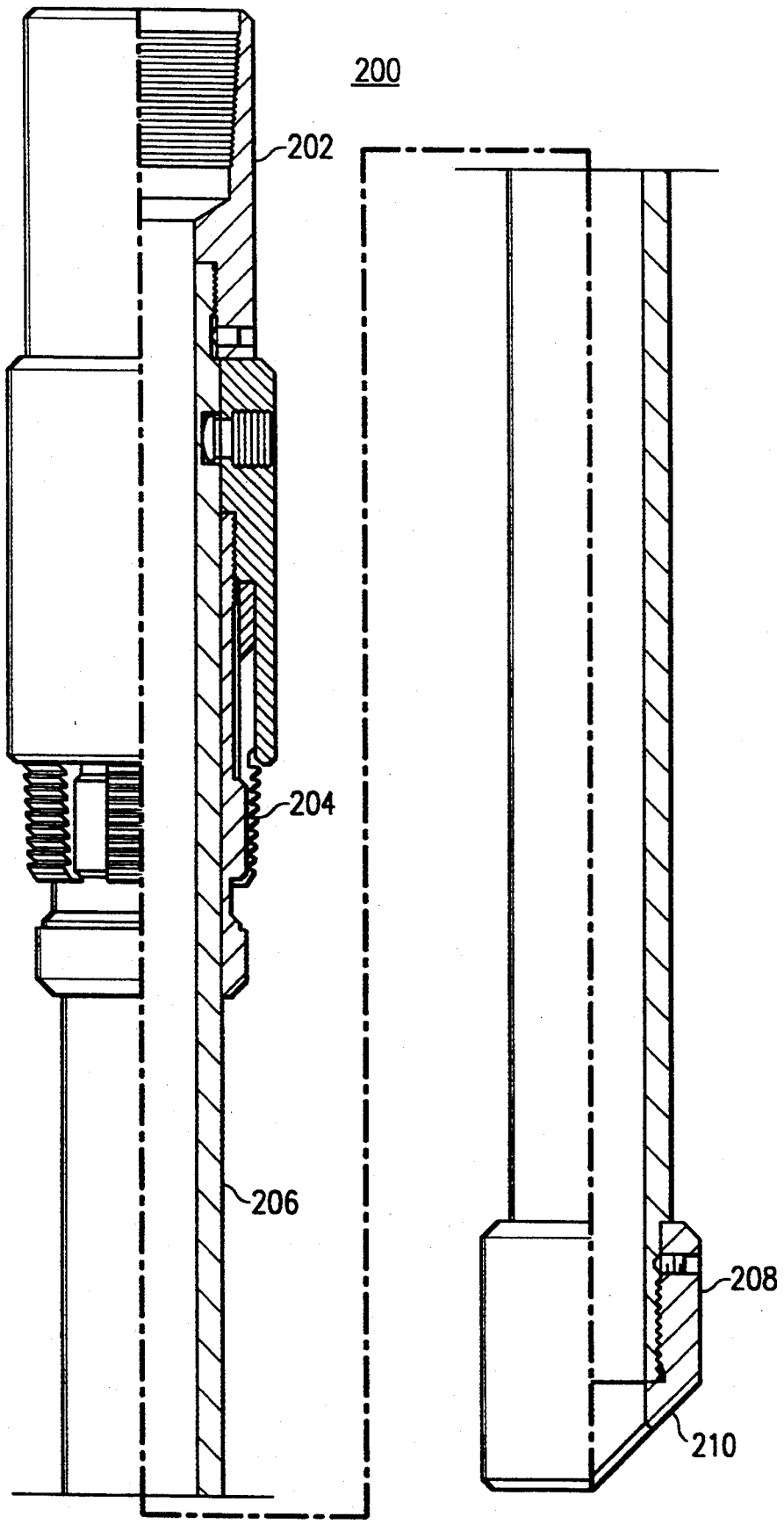

FIGS. *2a–2b* are partial sectional views of the case gripping apparatus of the invention prior to setting in a well casing;

FIGS. *3a–3b* illustrate the case gripping apparatus as set in a casing;

FIGS. *4a–4b* illustrate the case gripping apparatus after release thereof from the well casing;

FIG. 5 is a partial cross-sectional view of a retrieval tool for attaching to the gripping apparatus and retrieving it from the well; and FIGS. *6a–6b* illustrate partial cross-sectional views of the retrieval tool as it engages the well case gripping apparatus to manually remove it for engagement with the well casing.

DETAILED DESCRIPTION OF THE INVENTION

Figure 1:
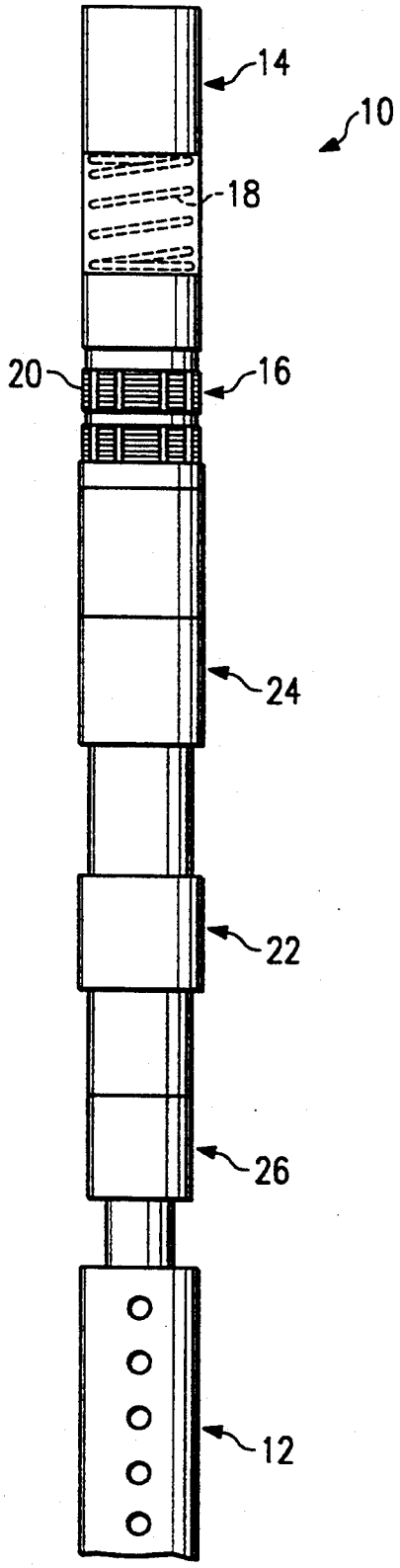
FIG. 1 is a side view of the well case gripping apparatus attached to a perforating gun, illustrating in generalized form the functional aspects of the invention.

With reference now to FIG. 1, there is illustrated the well case gripping apparatus 10 connected to a perforating gun 12 forming a unit that can be lowered into a cased wellbore. The perforating gun 12 can be any type that is generally available for perforating steel sidewalls and the annulus cement of wells. The invention is well adapted for use in monobore type casings.

In accordance with the preferred embodiment of the invention, the well case gripping apparatus 10 includes a compression and ratchet assembly 14 and a slip assembly 16. A tubing string is threadably engaged with the compression and ratchet assembly 14, and thus such assembly is operated by either pressurizing the drill string or by using a wire line conveyed pressure setting tool to compress a spring 18 and deploy the toothed slip segments 20 radially outwardly into engagement with a well casing (not shown). The deployment of the slip assembly by pressurizing the drill string is similar to that employed in setting packers in a wall casing. During the deployment of the slip assembly 16, a ratchet in the assembly 14 is operated to maintain the spring 18 in a compressed form, thereby maintaining an engaging pressure between the toothed slipped segments 20 and the internal sidewall of a casing. Once the slip assembly 16 is fully engaged with the casing, the tubing string can be removed from the gripping apparatus 10 and withdrawn from the well, while the apparatus 10 remains engaged with the casing for activation of the perforating gun. After activation, the gripping apparatus is automatically released from the casing to fall to the bottom of the well. It can thus be appreciated that the cased wellbore can remain contained or closed at the surface without the need of removing any of the perforating apparatus after operation thereof. While the invention is described in terms of operation with a tubing string, the well case gripping apparatus can be modified so as to be lowered into a well case by a wire line, cable or other device.

The preferred embodiment of the gripping apparatus 10 also includes a first release mechanism 22, a second release mechanism 24, and a detonator assembly 26 connected to the perforating gun 12. The detonator assembly 26 can be any type that is responsive to a hydraulic pressure, a mechanical impact or an electrical input for causing a detonation. In the preferred form of the invention, the detonator assembly 26 includes a detonating cord that extends to the perforating gun 12 so that ignition of the detonator assembly 26 causes a corresponding ignition internal to the perforating gun 12 to thereby cause perforations to be formed in the casing. The first release mechanism 22 is responsive to the ignition of the detonator assembly 26 to thereby allow the perforating gun 12 to be released to fall, but yet remain connected to the detonator assembly 26. Although the perforating gun 12 and the detonator assembly 26 are yet mechanically connected to the gripping apparatus 10, the kinetic energy of the released perforating gun 12 is effective to operate the second release mechanism 24. The second release mechanism 24 is connected to the slip assembly 16, and when operated, is effective to release the spring tension applied to the slip assembly 16 and thereby release its engagement with the well casing.

With reference now to FIGS. *2a–2b*, there is illustrated the well case gripping apparatus 10 in a preset condition, as it exists when initially run into a wellbore casing. A setting sleeve 50 is coupled to the outside surface of a top connection 52 by way of a toothed one-way lock ring 54. The lock ring 54 snugly fits on the outside of the top connection 52, but engages by way of teeth 56 formed therearound, with corresponding teeth on the inside surface of the setting sleeve 50. Such type of toothed lock ring is well known in the petroleum industry. The one-way lock ring 54 functions as a ratchet so that when the setting sleeve 50 is pushed down over the top connection 52, the setting sleeve 50 is ratcheted and locked in such position with respect to the top connection 52. The setting sleeve is moved downwardly by pressure applied via the drill string to a reaction shoulder 49.

A lock housing 58 is threadably engaged with the setting sleeve 50, and includes a slot (not shown) formed therein. Movable longitudinally in the slot is a mandrel lock 62 that is fastened to the top connection 52 by a cap screw. Thus, the lock housing 58 is prevented from rotation with respect to the top connection 52.

An L-shaped thimble 68 is threadably fastened to the lower part of the lock housing 58. As the setting sleeve 50 is forced downwardly over the top connection 52 in a ratcheting action, the thimble 68 compresses a coil spring 70 that encircles a mandrel 72 that is threadably fastened to the bottom part of the top connection 52. A protective sleeve 74 covers the coil spring 70. Further, the sleeve 74 is recessed at its upper end, and includes a shoulder 76 against which the bottom surface of the thimble 68 abuts when the spring 70 is fully compressed. The spring is of the type that maintains about a 1000 pound load on the toothed slips, to be described below.

Another thimble 78 is threadably fixed to the upper edge of an upper setting head 80, which setting head also encircles the mandrel 72. The upper setting head 80 is fixed to the mandrel 72 by a shear pin 82. The shear pin 82 shears when a predefined differential force exists between the top connection 52 and the setting sleeve 21. The upper head 80 includes a tapered wedge surface 84 that engages under a corresponding tapered surface of an upper, toothed slip segment 86. A number of upper slip segments 86 are located circumferentially around the well case gripping apparatus 10, each having downward, pointing teeth 90 for engaging with the inside wall of the casing. Indeed, the teeth 90 penetrate a short distance into the steel body of the casing, thereby supporting the total weight of the well case gripping apparatus 10 as well as the perforating gun 12, which together may weigh up to forty thousand pounds. The slip ring assembly 16 further includes plural lower slip segments 92 disposed around the mandrel 72 of the gripping apparatus 10. In the preferred embodiment, the lower slips 92 need not have toothed surfaces, but rather can be smooth and function primarily to center the gripping apparatus 10 within the wellbore casing. The upper slips 86 and the lower slips 92 are held around the mandrel 72 by a slip ring 94. The slip ring 94 is longitudinally movable up and down the mandrel 72. A lower setting head 96 has plural inclined surfaces 98 for wedging under corresponding inclined wedge surfaces on the undersurface of the lower slips 92. As the lower slip 92 and the lower setting head 96 move toward each other, the lower slip segments 92 are forced radially outwardly. The lower head 96 is threadably fastened to a collet housing 100. Once threadably fixed together, the parts are secured by a set screw 102.

Inserted within is a cylindrical insert 104 having spring fingers 106 that are engageable within a recessed area 108 of the collet housing 100. In other words, when the spring fingers 106 are forced outwardly and held within the recessed area 108, the collet housing 100 cannot move in a downward direction. A top sub 110 is threadably fixed to a bottom portion of the collet housing 100, and includes a raised land area 112 for preventing downward movement of the cylindrical insert 104 when the spring fingers 106 are held outwardly in the recessed area 108 of the collet housing 100. The top sub 110 further includes an annular recessed area 114 in which a no-go insert 116 is movable from an upper position which holds the spring fingers 106 in the recessed area 108 of the collet housing 100, to a lower position in the recessed area 114 of the no-go insert 116. When the no-go insert 116 is moved to the lower position, the spring fingers 106 are allowed to move freely inwardly and become released from engagement with the collet housing recessed area 108. When the spring fingers 106 are released in this manner, the collet housing 100 and the lower setting head 96 are free to move downwardly, if movement of the top sub 110 allows such downward movement.

Figure 2A:
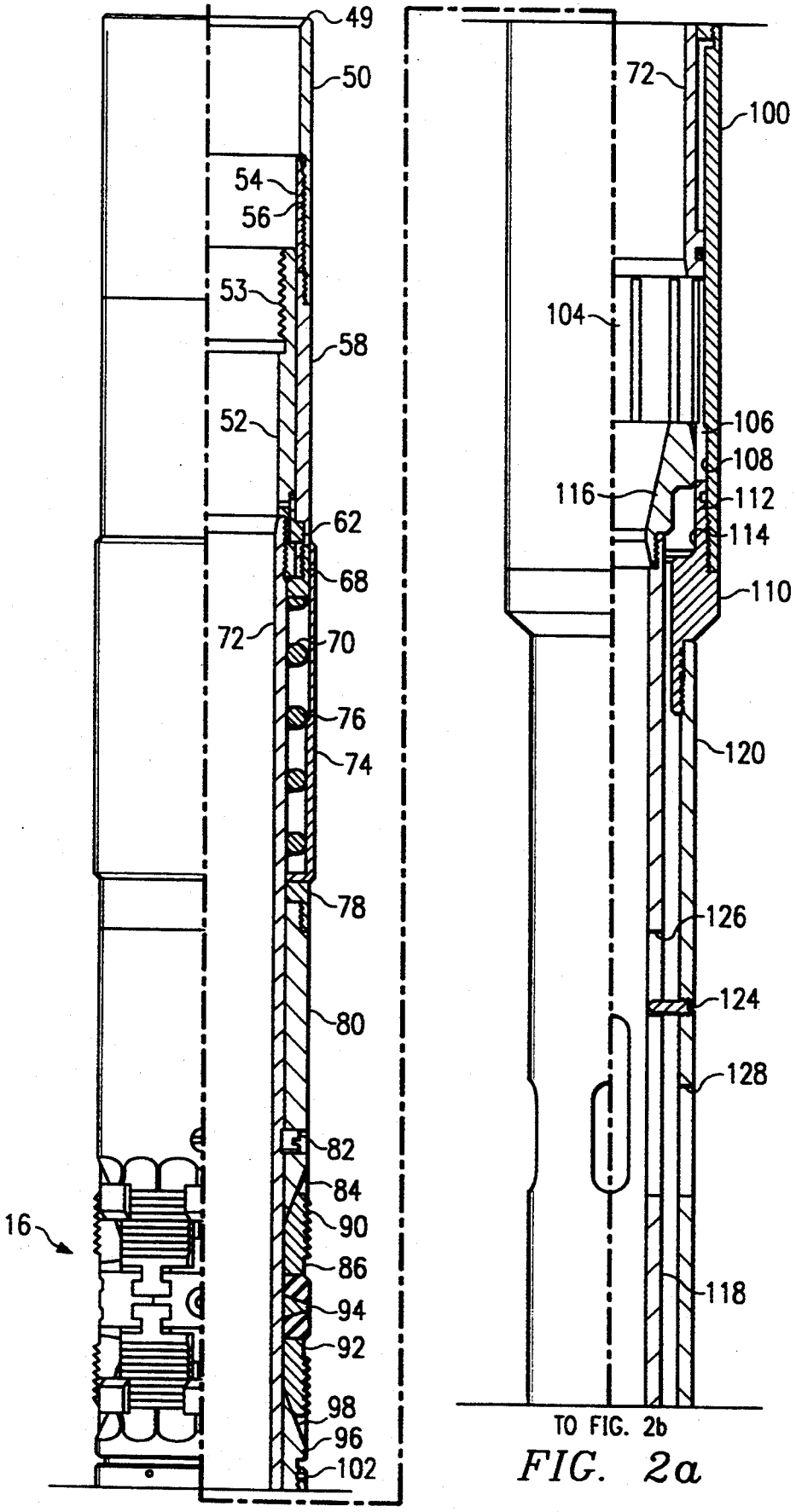

The no-go insert 116 includes a shoulder abuttable with a corresponding shoulder on the top sub 110 to limit downward movement of the no-go insert 116 with regard to the top sub 110. As noted in FIG. 2*a*, the no-go insert 116 is threadably fixed to a no-go tube 118. A housing 120 is threadably fastened to the top sub 110 and fixed by way of a set screw. An alignment pin 124 is threadably fastened to the housing 120 and is disposed within a longitudinal slot 126 of the no-go tube 118. Relative rotational movement is thereby prevented between the housing 120 and the no-go tube 118. Plural vent ports 128 are formed in the housing 120 to allow well pressure within the no-go tube 118 and prevent the existence of any differential pressure between the case gripping apparatus 10 and the well bore.

Figure 2B:
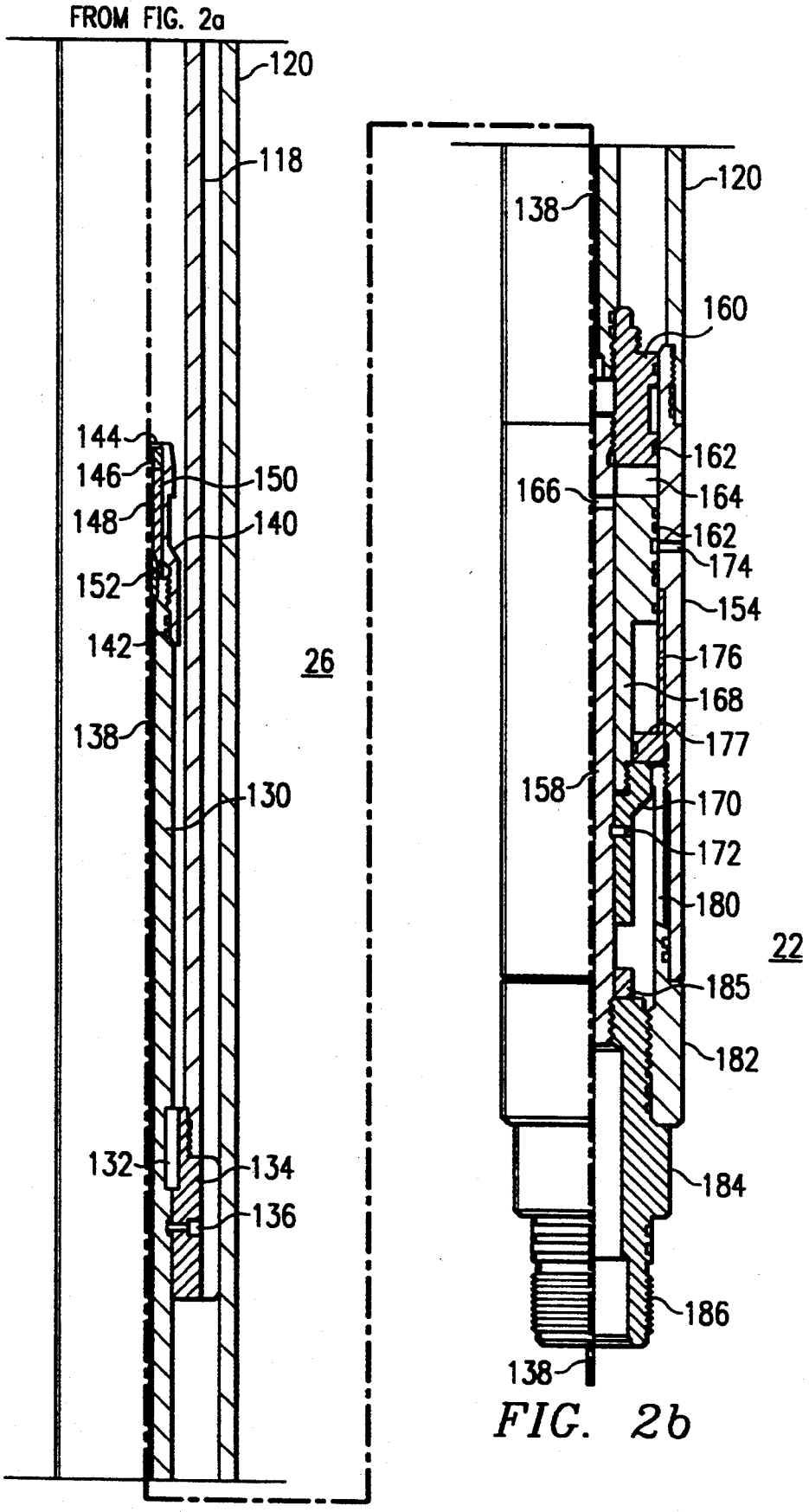

The detonator assembly 26 includes a primary arming stem 130 disposed within the no-go tube 118. This is shown in FIG. 2*b*. The arming stem 130 is attached to the bottom of the no-go tube 118 by a split locking sleeve 132 and a centralizer lock 134. Four fins are attached to the centralizer lock 134 to maintain such lock centered within the housing 120. The centralizer lock 134 is threadably fastened to the no-go tube 118, as well as being fastened to the arming stem 130 by a shearable set screw 136. The split locking sleeve 132 is engaged within an annular groove of the primary arming stem 130, and is held therein by the centralizer lock 134. In this manner, as the tubular body of the primary arming stem 130 is longitudinally pulled downwardly, it also carries with it the no-go tube 118, and thus also the no-go insert 116. As will be described more fully below, the release of the first release mechanism 22 allows the perforating gun 12 to initially drop, bringing with it the primary arming stem 130, which action pulls the no-go insert 118 downwardly to operate the second release mechanism 24.

The centralizer lock 134 functions to maintain attachment between the primary arming stem 130 and the no-go tube 118 during the foregoing operation, but also functions to separate these two structures if the unit fails and the second release mechanism is manually released by use of a retrieval tool (FIG. 5). In this latter action, the retrieval tool forces, via other structure, the no-go tube 118 downwardly, thus shearing the pinned connection between the no-go tube 118 and the primary arming stem 130, the latter remaining stationary. When the screen 136 is sheared, the downward movement of the no-go tube 118 carries with it the no-go insert 116, thereby allowing the collet spring fingers 106 to be released from the recessed area 108 of the collet housing 100. This action operates to activate the second release mechanism 24 and retract the slip assembly 16. From the foregoing, the second release mechanism 24 can be operated either by the normal activation of the perforating gun 12, or manually when a failure occurs to retrieve the unit from the wellbore casing.

While different types of primary arming stems 130 can be employed, the stem according to the preferred embodiment includes a detonating cord 138 that extends from the top part of the arming stem 130 down to the perforating gun 12 that is attached to the bottom part of the well case gripping apparatus 10. Fixed to the top of the arming stem 130 is a stem cap 140 sealed therein with O-rings 142. The top 144 of the stem cap 140 comprises a membrane 144 which, when broken, sets off an acceptor charge 146 of the ASM HNS type. The acceptor then sets off a booster charge 148 and thus the detonating cord 138. The detonating cord 138 is fastened to a stem insert 150 by a detonating cord retainer 152.

A reentry sub 154 shown in FIG. 2*b* is threadably fastened to the lower end of the housing 120 and is fixed by way of a set screw. A lower secondary stem 158 is fastened to the bottom of the primary arming stem 130 by way of an intermediate bulkhead 160. The bulkhead 160 is sealed by way of O-ring elastomeric seals 162 to the inside surface of the reentry sub 154. In practice, the bulkhead 160 defines an annular chamber 164 therebelow, between the outer sidewall of the lower secondary stem 158 and the internal sidewall of the reentry sub 154. A port 166 is formed in the sidewall of the lower secondary stem 158, providing a communication passage of explosive gases from the detonating cord 138 to the annular chamber 164. A piston 168 is sealed with O-rings to the inside surface of the reentry sub 154, and is threadably fastened at its bottom end to a locking sleeve 170 which, in turn, is fastened by a shearable set screw 172 to the lower secondary stem 158. Hence, downward movement of the piston 168 occasioned by the exploding detonating cord 138 causes the shear piston 172 to break and thus force the locking sleeve 170 downwardly also. An exhaust port 174 is formed through the sidewall of the reentry sub 154 so that when the piston 168 is forced downwardly sufficiently, due to pressure in the chamber 164, any further pressure in the well casing further facilitates the downward movement of the piston 168. A cylinder insert 176 provides an internal surface for sealing with O-rings to the piston 168, as well as provides a hammer surface 177 on which the piston hits when explosively forced downwardly.

The first release mechanism 22 includes a release sub 182 with spring fingers 180 that are threadably fastened at their upper ends to a threaded portion of the reentry sub 154. The larger-diameter portion of the locking sleeve 170 sandwiches the threaded part of the spring fingers 180 to the reentry sub 154 when the piston 168 is in the position shown, but allows disengagement of the mating threads between the spring fingers 180 and the reentry sub 154 when the piston 168 is forced downwardly. Essentially, the spring fingers 180 are individual extensions of a reentry sub 182, much like the spring fingers 106 of the cylindrical insert 104 associated with the second release mechanism 24. A bottom portion of the release sub 182 is threadably fixed to the arming sub 184. The arming sub 184 also includes a threaded bore for receiving therein the lower secondary stem 158. Surrounding the bottom part of the lower secondary stem 158 is a brass stop 185 to cushion the downward slamming of the locking sleeve 170 in response to the explosive movement of the piston 168. The arming sub 184 has external threads 186 for fastening thereto a conventional perforating gun (not shown). The detonating cord 138 exiting the case gripping apparatus 10 is routed into the perforating gun 12 to trigger activation thereof.

The well case gripping apparatus 10 is fully assembled at the surface of the well and attached to the perforating gun 12 so that the unit can be lowered into the well casing. A tubing string can be threadably connected to the top connection 52 of the case gripping apparatus 10. The tubing string is preferably equipped with a shoulder engageable with the reaction shoulder 49 of the setting sleeve 50. When the tubing string is threadably connected to the top connection 52, the entire well case gripping apparatus 10 and attached perforating gun 12 are lowered into the casing to the proper depth. While a single perforating gun is shown in FIG. 1, numerous such guns can be attached in a series to the gripping apparatus 10 to thereby perforate various intervals along the casing. Once the perforating gun 12 and attached apparatus has been lowered to the proper location in the well casing, the collar on the drill string is hydraulically forced downwardly to thereby force the setting sleeve 50 downwardly in a ratcheting movement over the top connection 52.

Figure 3A:
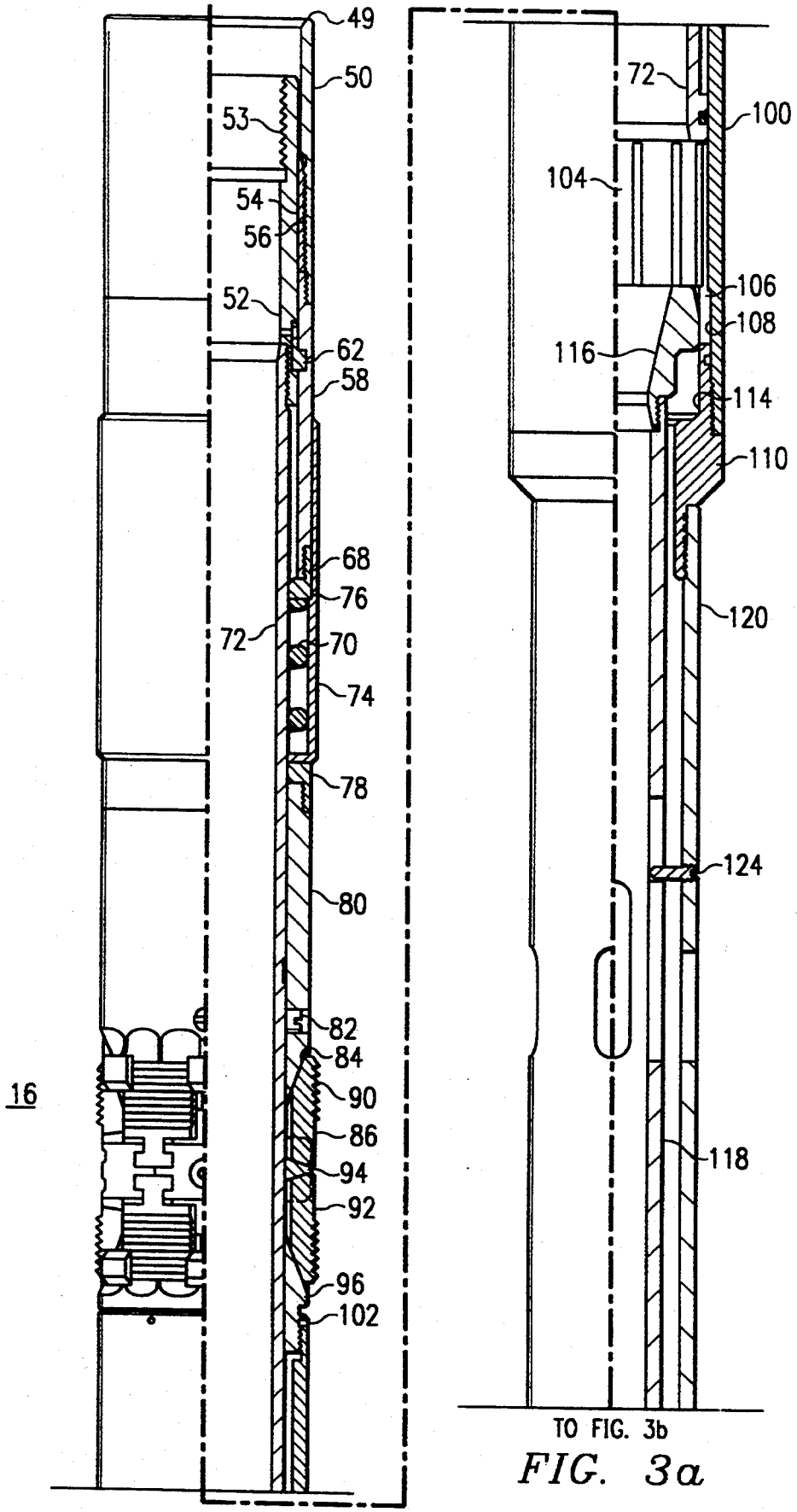
Figure 3B:
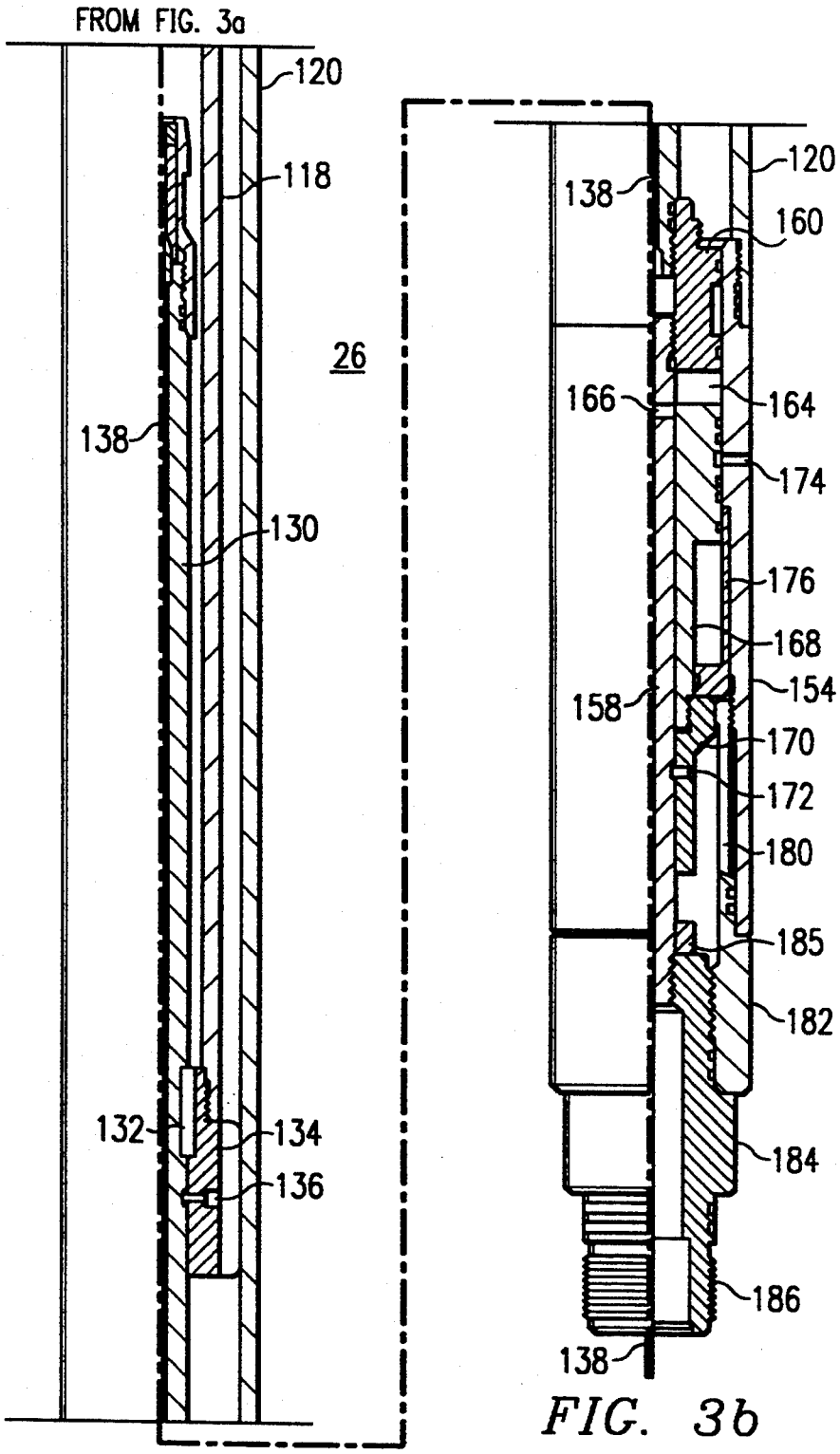

FIGS. 3*a* and 3*b* illustrate the relative location of the parts of the well casing gripping apparatus 10 when engaged with the internal surface of the casing. As noted above, the downward movement of the setting sleeve 50, via the one-way ratcheting lock ring 54, causes the heavy duty coil spring 70 to be compressed. The compression of the spring 70 shears the screw 82 and as a result forces the upper setting head 80 downwardly, thereby forcing the wedging surfaces 84 under the toothed upper slip segments 86. This action not only causes the upper toothed slip 86 to move radially outwardly, but also causes the slip ring 94 and the lower toothless slip 92 to move downwardly somewhat onto the stationary wedging surfaces 98 of the lower setting head 96. Hence, the downward movement of the upper setting head 80 causes both the upper tooth slip segments 86 and the lower slip segments 92 to be deployed radially outwardly in engagement with the internal sidewall of the casing. While the lower slip segments 92 tend to center the gripping apparatus 10 in the casing, the teeth 90 of the upper toothed slip segments 86 each dig into the metal casing sidewall and thereby anchor the gripping apparatus 10 therein. The compressed spring 70 and the deployed slip assembly 16 is clearly shown in FIG. 3*a*. Once the thimble 68 is bottomed out against the shoulder 76 of the spring sleeve 74, the spring 70 is fully compressed and the slips 86 are fully deployed in gripping engagement with the casing. Further, the one-way lock ring 54 maintains the relative positions between the setting sleeve 50 and the top connection 52, thereby allowing the tubing string to be disconnected from the gripping apparatus 10 and removed. Once the tubing string is removed from the well, the casing can be contained or otherwise prepared for production from the hydrocarbon formation, after perforations are formed in the casing.

The case gripping apparatus 10 having been set, the detonator assembly 26 is ready for activation to correspondingly activate the perforating gun 12, as well as disengage the gripping apparatus 10 from the well casing. While not shown, electrical or hydraulic pressure responsive apparatus can be connected to step cap 140 of the arming stem 130 to ignite the detonating cord 138. Alternatively, a go-devil can simply be dropped down the casing to strike a firing head (not shown) attached to the stem cap 140 and thereby set off an ignition of the arming stem 130, via the acceptor charge 146 and the booster charge 148 and lastly, the detonating cord 138.

In any event, once the detonating cord 138 is ignited, the explosion thereof detonates the perforating gun 12 to thereby form apertures or perforations through the wellbore casing as well as through any cement therearound. Channels are thereby produced between the inside bore of the casing and the hydrocarbon formations. In the event the formations are pressurized by the natural gases, the hydrocarbons are explosively forced into the inner bore of the casing.

Concurrent with the ignition of the detonating cord 138 and activation of the perforating gun 12, the extreme gas pressures generated by the cord are coupled through the port 166 of the lower secondary stem 158 into the annular piston chamber 164. The expanding gases explosively force the piston 168 downwardly and with it the locking sleeve 170, thereby shearing the set screw 172. The secondary stem 138 is thus disconnected from the locking sleeve 170. The violent nature of the explosion of the detonating cord 138 causes the locking sleeve 170 to move downwardly and slam against the brass stop 185. The downward movement of the locking sleeve 170 releases the spring fingers 180 of the release sub 182 and allows it to be disengaged from the reentry sub 154. Further, the piston hits the flanged portion of the cylinder sleeve 176 which in turn, applies a downward force on the top edge of the spring fingers 180. This facilitates the release of the release sub 182 from its threaded engagement with the reentry sub 154. The weight of the perforating gun 12 on the arming sub 184 and the release sub 182 causes the assembly to be disengaged and fall from the reentry sub 154. The downward movement of the arming sub 184 also carries with it the lower secondary stem 158 and the primary arming stem 130. The no-go insert 116 and attached no-go tube 118 are also pulled downwardly, in that they are attached through the centralizer lock 134 to the primary arming stem 130. The initial dropping of the perforating gun 12, through the apparatus identified above, pulls the no-go insert 116 downwardly, thereby releasing the spring fingers from engagement with the recess 108 in the collet housing 100.

Figure 4A:
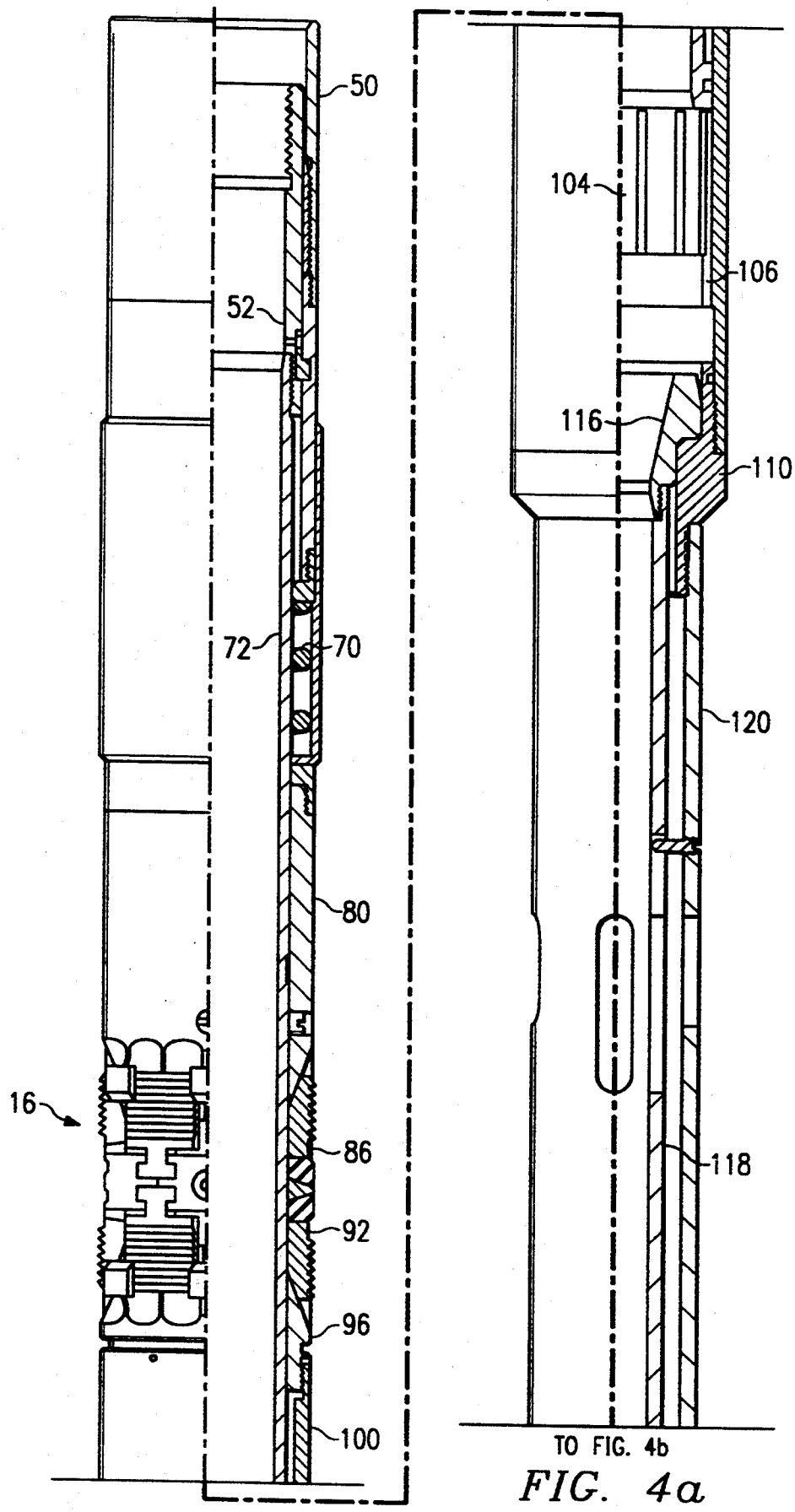
Figure 4B:
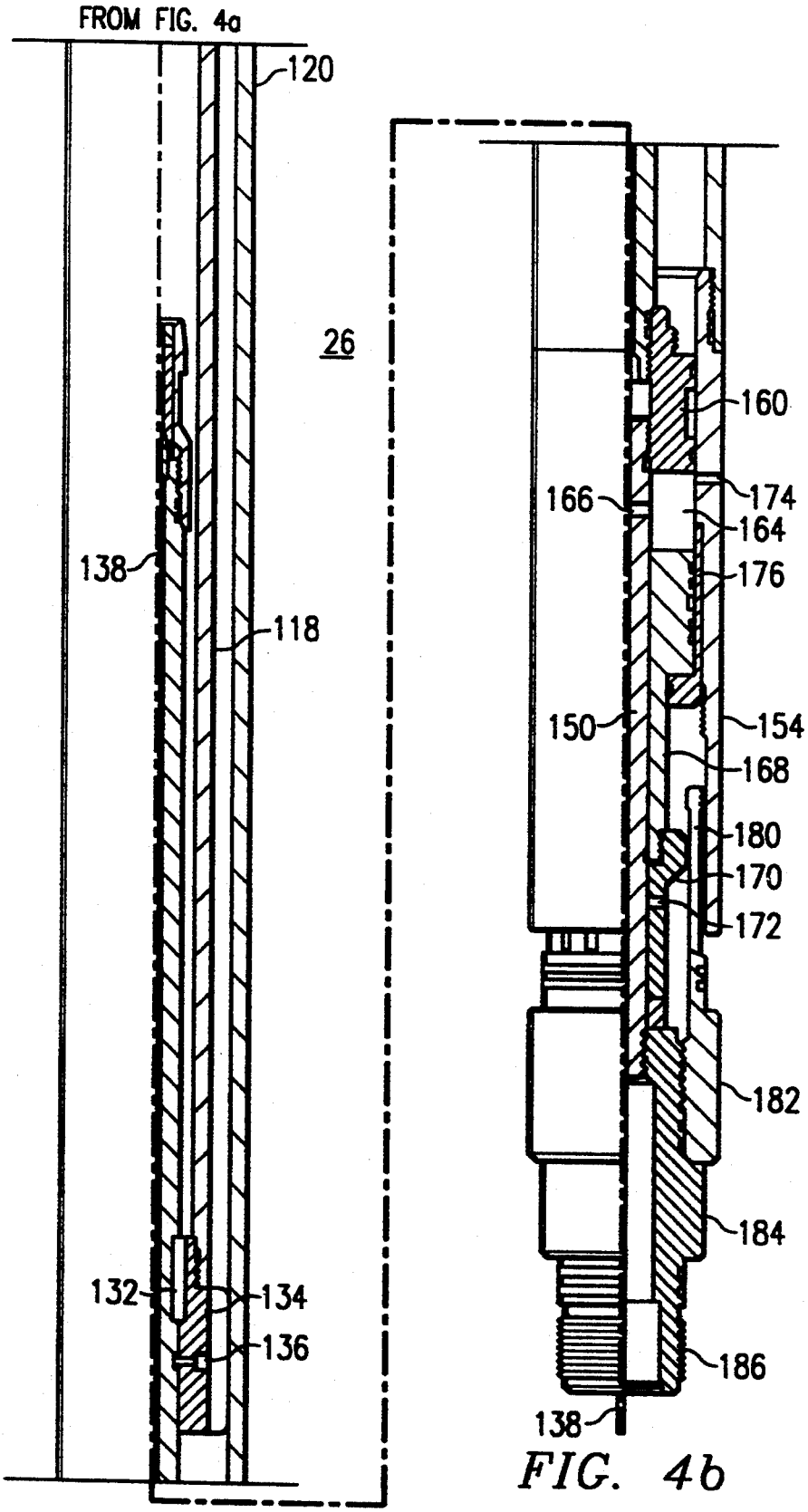

When the no-go insert 116 drops and bottoms out on the shoulder of the top sub 110, a downward force is thereby exerted on the top sub 110, thereby carrying with it the collet housing 100 and the lower setting head 96. The downward movement of the lower setting head 96 removes its wedging with the lower slip segments 92, allows the slip ring 94 to move downwardly as well as the upper toothed slip segments 86. This action thus removes the engagement of lower slips 92 from the casing, as well as allows the upper toothed slips 86 to be disengaged from the casing sidewall. Indeed, the falling of the heavy perforating gun 12 functions as a hammer on the entire well case gripping apparatus 10, thereby causing the upper toothed slip segments 86 to shear out against the inside surface of the well casing. The entire unit is thus released, allowing it to drop to the bottom of the casing. FIGS. 4*a* and 4B illustrate the relative positioning of the parts of the well case gripping apparatus 10 when fully released from the casing.

In the event the ignition of the primary arming stem 130 fails, or the detonation of the perforating gun 12 fails, or for whatever reason the well casing is not perforated, the entire gripping apparatus 10 and the attached perforating gun 12 can be retrieved from the cased wellbore. In order to release the slip assembly 16 from its gripping action with the casing, a retrieving tool 200, shown in FIG. 5, is utilized. The retrieving tool 200 includes an internally threaded end 202 for coupling to a tubing string (not shown). The retrieving tool 200 also includes external threads 204 that can be threadably engaged with the internal threads 53 of the top connection 52. Coupled to the end of the head of the retrieving tool 200 is a elongate tubular shaft 206. At the end of the shaft 206 is an engaging end 208 having a beveled end 210. The beveled end 210 of the retrieval tool 200 provides self-centering thereof within the no-go insert 116 of the gripping apparatus 10.

Figure 6A:
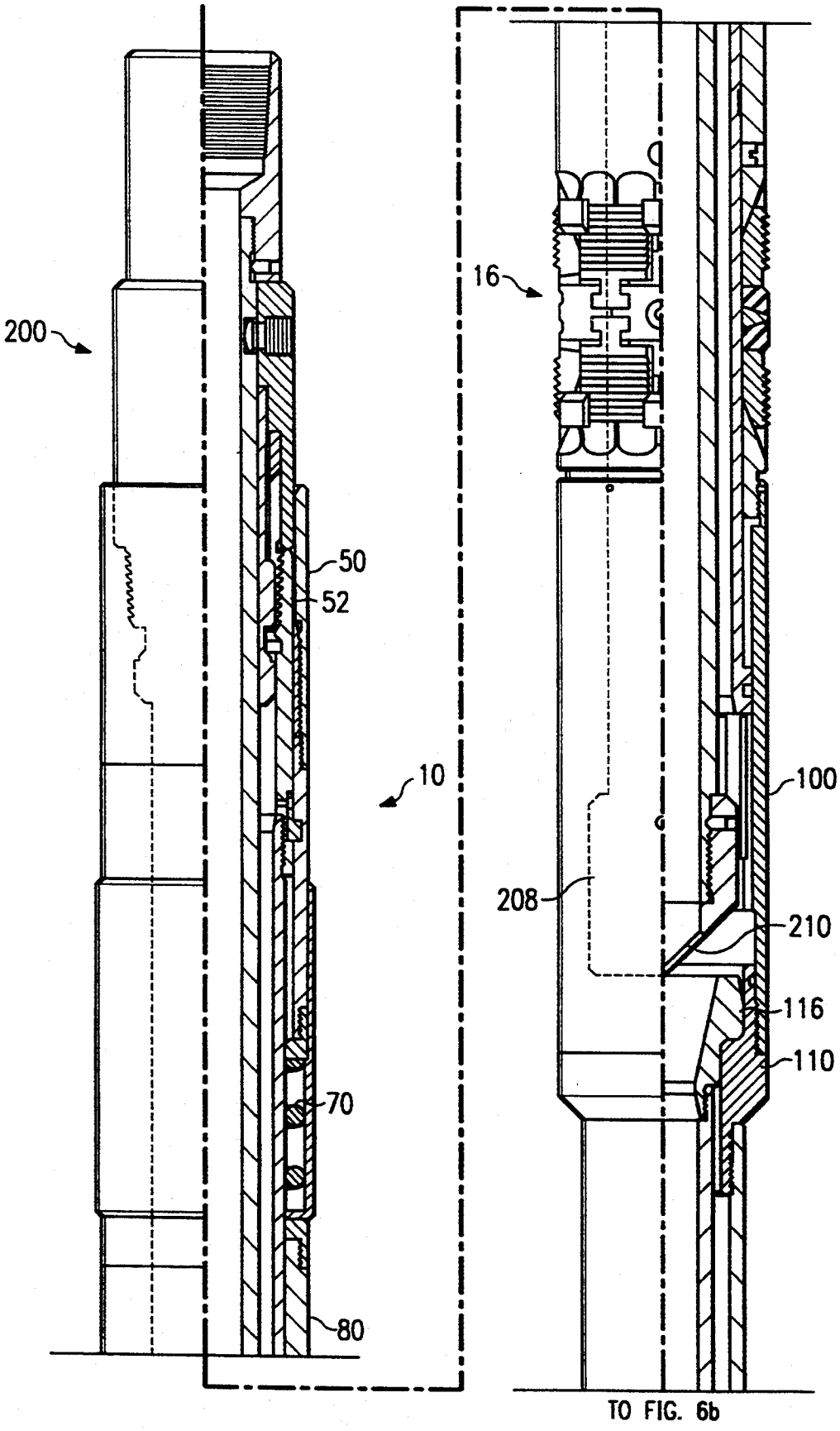
Figure 6B:
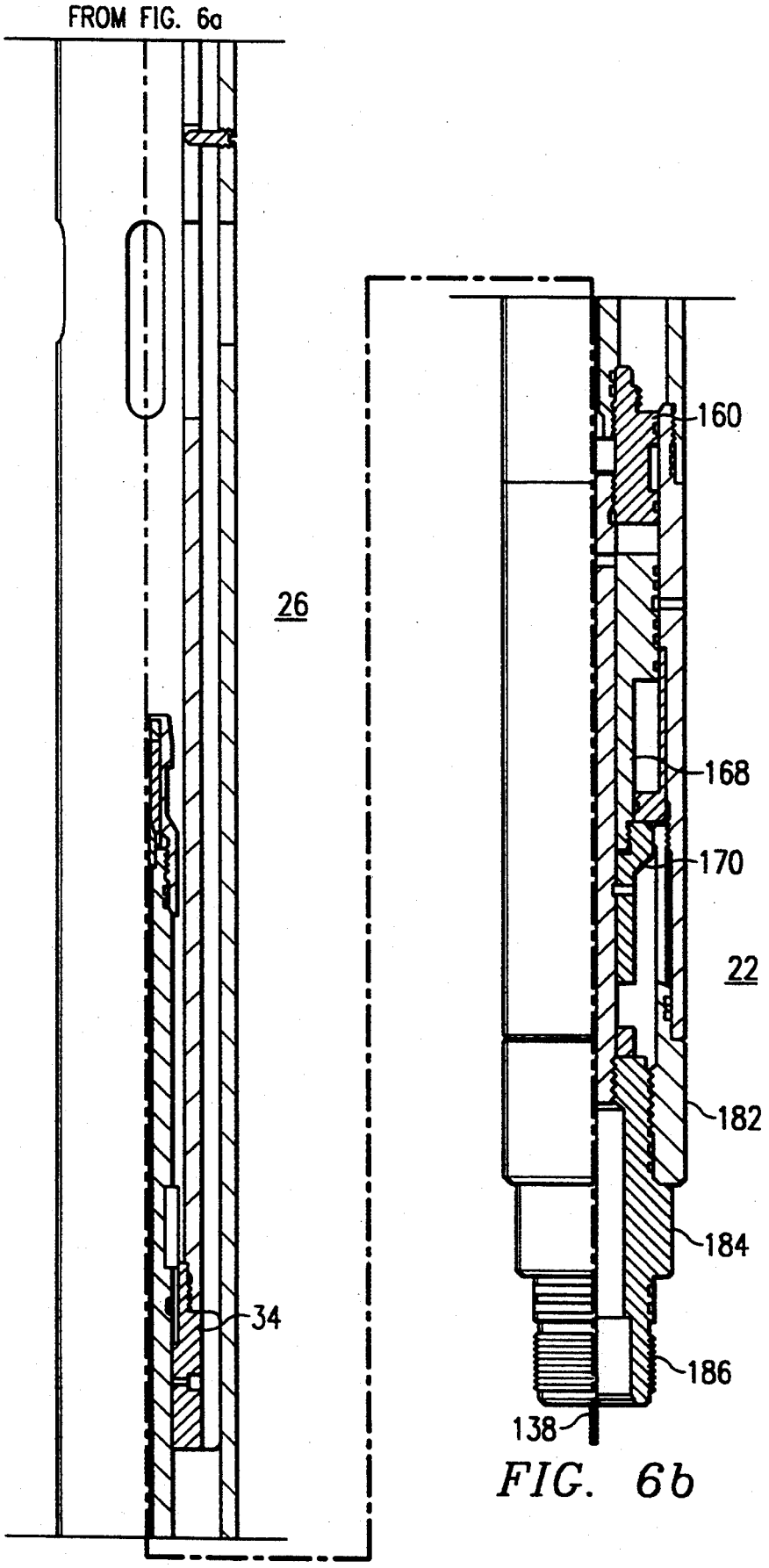

FIGS. 6*a* and 6*b* illustrate the engagement of the retrieval tool 200 within the well casing gripping apparatus 10 to manually release the slip assembly 16. The retrieval tool 200 is rotated by action of the tubing string, thereby threadably engaging the tool threads 204 within the threads 53 of the top connection 52. As the retrieval tool 200 is threaded into the gripping apparatus 10, the beveled end 210 pushes down on the no-go insert 116. When a predefined amount of force is exerted downwardly on the no-go insert 116, the screw 136 between the centralizer lock 134 and the primary arming stem 130 shears. This allows the no-go tube 118 to move downwardly independently of the arming stem 130. When the retrieval tool 200 is fully seated within the top connection 52, the no-go insert 116 has been moved downwardly sufficiently to release the spring fingers 106 from engagement with the recess 108 of the collet housing 100. With the disengagement of the collet spring fingers 106 from the housing 100, the weight of the perforating gun 12 pulls the collet housing 100 downwardly, carrying with it the lower setting head 96. This allows the slip assembly 16 to be disengaged from the internal surface of the casing in the same manner described above. However, in this situation, the entire unit does not fall, but is held by the tubing string and the retrieval tool 200. Once disengaged from the casing, the entire unit can be retrieved from the well by withdrawing the tubing string and carrying with it the well case gripping apparatus 10 and the perforating gun 12.

In view of the foregoing, disclosed is a highly versatile perforating gun apparatus that can be reliably engaged with a well casing for supporting a perforating gun at a desired location, without being suspended by a tubing string, wire line, etc. Once the perforating gun is detonated, the detonating cord extending through the well case gripping apparatus causes a first release mechanism to operate, thereby dropping the perforating gun 12 a short distance. As the perforating gun falls, a second release mechanism operates, thereby releasing the slip assembly from its engagement with the casing. As a result, the entire unit is responsible to the detonation of the gun to perforate the well casing, as well as disengage the unit from the casing and allow it to fall to the bottom of the well.

In the event that ignition or detonation is not completed, a retrieval tool can be attached to a tubing string to retrieve the entire unit. The retrieval tool can be threadably coupled into the well case gripping apparatus, thereby automatically operating the second release mechanism to corresponding release the slip assembly from the casing. Once released, the entire unit can be retrieved from the well via the tubing string.

While the preferred embodiment of the invention has been disclosed with reference to a particular gripping apparatus and retrieval tool, and operation thereof, it is to be understood that many changes in detail may be made as a matter of engineering choices without departing from the spirit and scope of the invention, as defined by the appended claims.

What is claimed is:

1. Apparatus engageable with a well casing for suspending therefrom a perforating gun, comprising:

a releasable slip assembly responsive to an axial differential movement of the apparatus for deploying toothed slips radially outwardly and in engagement with the well casing;

a first releasable connection responsive to ignition of the perforating gun for releasing the perforating gun and allowing the perforating gun to fall; and a second releasable connection responsive to the movement of the falling perforating gun for releasing the slip assembly from engagement with the well casing, thereby allowing the apparatus to fall within the well casing.

2. The apparatus of claim 1, further including a spring responsive to said differential movement for compressing during deployment of the slip assembly, said spring functioning to force said slips into engagement with the well casing.

3. The apparatus of claim 1, wherein said slip assembly comprises an upper set of toothed slips for gripping engagement with the well casing, and a lower set of toothless slips for centering the apparatus within the well casing.

4. The apparatus of claim 1, further including in combination a retrieval tool operative to operate the second releasable connection and retrieve the apparatus and the perforating gun from the well casing when the perforating gun fails to fire.

5. Apparatus engageable with a well casing for suspending therefrom a perforating gun, comprising:

a first part telescopic with respect to a second part and having a spring resisting telescopic compression between the first part and second part;

a tooth slip assembly having plural toothed slip segments deployed outwardly in response to telescopic compression of the first and second parts, said toothed slip segments for engaging with an internal sidewall of the well casing;

ratchet apparatus responsive to the telescopic compression for maintaining said spring compressed between said first and second parts, whereby said spring facilitates engagement of said toothed slip segments with said well casing;

a connection for suspending a perforating gun from said apparatus;

a detonating assembly in said apparatus for causing activation of said perforating gun; and a slip release mechanism responsive to actuation of said detonating assembly to operate said slip release mechanism to thereby disengage the tooth slip assembly from the casing so that said apparatus falls within said well casing.

6. The apparatus of claim 5, further including a piston responsive to operation of said detonation assembly for moving from a first position that maintains said first part attached in compression to said second part, to a second position for releasing engagement between the first and second parts.

7. The apparatus of claim 6, further including a perforating gun stem assembly slidably mounted within said apparatus, and said perforating gun is attached to said stem assembly, and wherein movement of said piston to said second position is operative to release said perforating gun stem assembly and by the weight of said perforating gun, said stem assembly is pulled downwardly to operate said slip release mechanism.

8. The apparatus of claim 5, further including a set of non-toothed slip segments arranged for centering said apparatus within said well casing.

9. The apparatus of claim 5, wherein said slip release mechanism includes:

a first release mechanism responsive to activation of said detonating assembly for allowing downward movement of the perforating gun; and a second release mechanism responsive to the downward movement of the perforating gun for releasing engagement of the tooth slip assembly from the well casing.

10. The apparatus of claim 9, wherein said first and second release mechanisms each include spring fingers releasably engageable with said apparatus.

11. The apparatus of claim 5, wherein the detonating assembly further includes a primary arming stem having a detonator, and a secondary arming stem carrying through it a detonating cord, and a bulk head connecting the primary and secondary arming stems together.

12. The apparatus of claim 11, further including a piston, and a piston chamber formed between said bulkhead and said piston, and a port for carrying pressurized gases resulting from detonation of said detonating cord to said piston chamber.

13. The apparatus of claim 5, wherein said detonating assembly includes a stem carrying a detonation cord from the apparatus to the perforating gun.

14. The apparatus of claim 13, wherein said detonation cord is arranged so as to be operative on detonation thereof to operate said slip release mechanism and said perforating gun.

15. Apparatus engageable with a well casing for suspending therefrom a perforating gun, comprising:

a slip assembly having slip segments for engaging a sidewall of the well casing;

a detonation assembly in said apparatus having a detonation cord extending to the perforating gun;

a first release mechanism responsive to a detonation of said detonating cord for allowing said perforating gun to drop from said apparatus; and a second release mechanism responsive to the dropping of said perforating gun for releasing said slip assembly from engagement thereof with the well casing, thereby allowing the apparatus and the perforating gun to fall to the bottom of the well casing.

16. The apparatus of claim 15, further including in combination a retrieving tool connectable to said apparatus for operating said second release mechanism and retrieving said apparatus and the perforating gun from the well casing when the perforating gun fails to fire.

17. Apparatus engageable with a well casing for suspending therefrom a perforating gun, comprising:

a setting sleeve;

a top connection;

a ratchet mechanism attached between said setting sleeve and said top connection to provide one-way movement therebetween;

a slip arrangement having upper toothed slip segments and lower non-toothed slip segments;

wedging apparatus movable with respect to said upper and lower slip segments for deploying said segments radially outwardly into engagement with said well casing;

a coil spring disposed between said setting sleeve and said wedging apparatus for applying a force to said wedging apparatus when said setting sleeve is moved with respect to said top connection;

a first release mechanism for maintaining said perforating gun attached to said apparatus;

a second release mechanism for maintaining said slip segments deployed radially outwardly;

a stem assembly carrying a detonating cord to the perforating gun and operable with said first release mechanism; and a piston responsive to detonation of said detonating cord for moving and releasing the first release mechanism to thereby allow the perforating gun to drop, the dropping of the perforating gun being operative to operate the second release mechanism and allow the slip segments to retract, thereby disengaging the apparatus from the casing.

18. A method of releasing a perforating gun apparatus from engagement with a casing, comprising the steps of:

lowering the perforating gun apparatus into the casing with a suspension member;

fixing the apparatus in the casing by engagement therebetween using said suspension member;

removing the suspension member from the perforating gun apparatus;

detonating the perforating gun to form perforations within the casing;

in response to said detonation, releasing the perforating gun and allowing the gun to fall with respect to the apparatus;

in response to the falling movement of the perforating gun, releasing the apparatus with respect to the casing; and allowing the weight of the perforating gun to complete a disengagement of the apparatus from a gripping action with the casing.

19. The method of claim 18, further including fixing the assembly in the casing by applying a force under spring tension to an upper head to wedge a slip assembly toward a stationary lower head, and said releasing of said apparatus is carried out by allowing the lower head to move and remove a wedging action between the upper head and the slip assembly.

20. The method of claim 18, wherein said releasing of the apparatus comprises releasing a first release mechanism having a first set of engaging spring fingers, and thereafter releasing a second release mechanism having a second set of engaging spring fingers.

* * * * *